United States Patent [19]

Beretta et al.

[11] 4,337,305

[45] Jun. 29, 1982

[54] SENSITIZED ORGANIC ELECTRON DONOR COMPOUNDS

[75] Inventors: Paolo Beretta, Ferrania/Savona, Italy; Louis M. Leichter, Woodbury; John J. Stofko, Jr., St. Paul, both of Minn.

[73] Assignee: Minnesota Mining and Manufacturing Company, St. Paul, Minn.

[21] Appl. No.: 236,654

[22] Filed: Feb. 23, 1981

[51] Int. Cl.[3] ..... G03G 5/04; G03G 5/09

[52] U.S. Cl. ..... 430/82; 430/83

[58] Field of Search ..... 430/900, 58, 81, 82, 430/83

[56] References Cited

U.S. PATENT DOCUMENTS 4,264,694 4/1981 Pu et al. ..... 430/58

*Primary Examiner*—John D. Welsh

*Attorney, Agent, or Firm*—Cruzan Alexander; Donald M. Sell; Mark A. Litman

[57] ABSTRACT

Organic electron donor compounds for use in electrophotographic constructions must ordinarily be sensitized to desired regions of the electromagnetic spectrum. Indolenine dyes having phenylsulfonyl or benzoyl substituents thereon have been found to be efficient sensitizers, particularly in the infrared portion of the electromagnetic spectrum, for such organic donor compounds.

8 Claims, No Drawings

SENSITIZED ORGANIC ELECTRON DONOR COMPOUNDS

TECHNICAL FIELD

The present invention relates to novel photoconductive layers which comprise organic electron donor compounds and phenylsulfonyl or benzoyl substituted indolenine sensitizer dyes. These layers are particularly useful in imaging systems such as electrophotography or electroradiography.

BACKGROUND OF THE ART

The technology of electrophotography is commercially well established. A wide variety of processes and apparatus are used although they have many characteristics in common. One of the more common forms of this technology involves the use of a plate having a photoconductive insulating layer, generally coated on a conductive layer. Imaging is effected by first uniformly electrostatically charging the surface of the photoconductive layer and then exposing the charged layer to an image or pattern of activating electromagnetic radiation, usually visible light or ultraviolet radiation. This exposure selectively enables the charge in the irradiated areas of the photoconductive insulator to dissipate. The charge which remains in the non-irradiated areas forms a latent image which may be further processed to form a more permanent record of the exposing image or pattern. The most common form of additional processing involves the attraction of particles of material selectively to the charged areas and fusing them to the photoconductive layer or transferring the particles in their imagewise distribution to another surface to which they are more permanently bound by an adhesive or by fusion of the particles themselves.

Typical classes of photoconductive materials useful in electrophotography include (1) inorganic crystalline photoconductors such as cadmium sulfide, cadmium sulfoselenide, cadmium selenide, zinc sulfide, zinc oxide, and mixtures thereof, (2) inorganic photoconductive glasses such as amorphous selenium, selenium alloys, and selenium-arsenic, and (3) organic photoconductors such as phthalocyanine pigments and polyvinyl carbazole, with or without binders and additives which extend their range of spectral sensitivity. These systems are well known in the art. For example, U.S. Pat. No. 3,877,935 discusses various problems associated with the crystalline and amorphous classes of photoconductors and shows the use of polynuclear quinone pigments in a binder as a photoconductive layer. U.S. Pat. No. 3,824,099 shows the use of squaric acid methine sensitizing dyes and triaryl pyrazoline charge transport materials as an electrophotographic construction. Cadmium sulfoselenide plates are shown in U.S. Pat. No. 3,764,315, and one of the original disclosures of the use of poly-N-vinylcarbazole as a photoconductive insulating layer is provided in U.S. Pat. No. 3,037,861. A number of diverse organic photoconductors have been disclosed since the development of the carbazole class of photoconductors such as quinones and anthrones (e.g., Hayashi et al., *Bull. Chem. Soc. Japan,* vol. 39, (1966) pp. 1670–1673), but the carbazoles have continued to attract the greatest attention.

Problems particularly associated with the use of carbazoles as a positive charge transporting material which is capable of supporting the injection of photoexcited holes from a photoconductive layer and is capable of transporting the injected holes also exist in this area of technology. The carbazole condensates with aldehydes as shown in U.S. Pat. No. 4,025,341 have a tendency to oligomerize. This oligomerization can cause a number of problems. The oligomers formed are not of a uniform molecular weight and carbazole content. This creates problems in purification and can create undesirable variations in photoconductive or charge transport properties. Triaryl methanes including a carbazole moiety (as shown in Xerox Disclosure Journal, Vol. 3, No. 1, Jan/Feb 1978, page 7) also tend to be sensitive to oxidation which converts them to an ionic species which will not act as a photoconductive insulator but rather will act as a conductor.

Japanese Patent Publication 52-34735 discloses carbazole organic photoconductor materials which may have substituents thereon which would inherently prevent oligomerization of the carbazoles. This is not recognized in the disclosure and the carbazoles would still be subject to oxidation problems.

SUMMARY OF THE INVENTION

Electronically active organic donor compounds have been found to be sensitized by 5-phenylsulfonyl or 5-benzoyl substituted indolenine dyes.

A novel class of electronically active organic donor compounds particularly useful in the present invention has the formula:

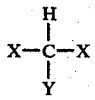

where X is

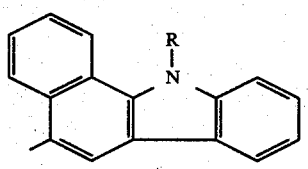

or

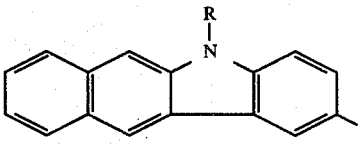

wherein R is an aliphatic, aromatic, or mixed aliphatic-aromatic group and Y is an aliphatic, aromatic or mixed aliphatic-aromatic group. For example, R and Y may be independently selected from alkyl groups, benzyl groups, phenyl groups, naphthyl groups, anthracyl groups, etc., with such various substituents as alkoxy groups, amine groups, alkyl groups, hydroxyl groups, and halogen atoms thereon.

These compounds have been found to be electron donor compounds and are useful in forming photoconductive layers when sensitized with cyanine dyes having an indolenine nucleus. They may be combined with polymeric binder materials to form photoconductive layers which are solid state molecular solution charge transport layers. The electron donor compounds have a reduced sensitivity to oxidation and oligomerization.

DETAILED DESCRIPTION OF THE INVENTION

All electronically active organic donor compounds, as they are known in the art, may be sensitized to various portions of the electromagnetic spectrum, particularly the near infrared and infrared, by phenylsulfonyl or by benzoyl substituted indolenine cyanine dyes. Typical electronically active organic electron donor compounds are poly-N-vinylcarbazole, polyanthracene, oxadiazoles, pyrazolines, poly(vinyl acenaphthalene), poly-2,9-methylene fluorene, polyvinyl ferrocene, polybenzocarbazole, polybenzoanthracene, and the like.

Novel electronically active organic donor compounds useful in the practice of the present invention are bis (benzocarbazoles)trisubstitutedmethanes which may be represented by the formula

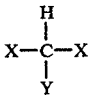

wherein X is

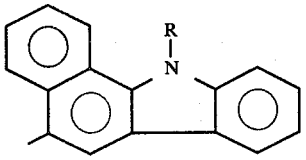

or

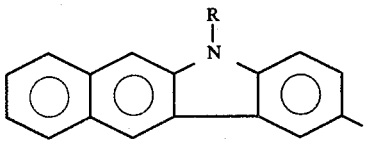

wherein R is an aliphatic, aromatic or mixed aliphatic-aromatic group and

Y is an aliphatic, aromatic or mixed aliphatic-aromatic group.

All of the novel organic electronically active donor compounds of the present invention may be synthesized by reacting the appropriate N-substituted benzo[a]carbazole or benzo[b]carbazole:

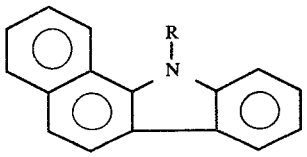

or

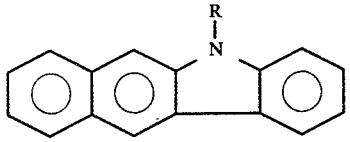

with the correspondingly appropriate aldehyde:

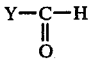

This process can be carried out in a solvent (e.g., ethanol) in the presence of an acid (e.g., HCl) catalyst. The reaction product may be isolated by simple filtration and washing. For example, in the reaction of 11-ethylbenzo[a]carbazole with benzaldehyde in ethanol in the presence of HCl as a catalyst, the preferential reaction of the aldehyde at the 5-position of the 11-benzo[a]carbazole and the insolubility of the reaction product:

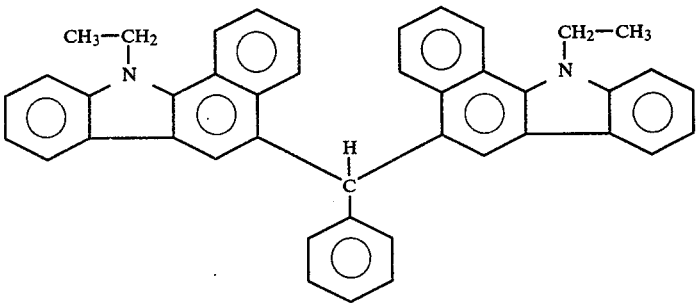

in ethanol, no oligomeric species are formed such as occur in a similar reaction with N-ethyl-carbazole. The reaction product is also stabilized against oxidation of the methine group by the rings ortho to point at which the methine group is bonded to the benzocarbazole nucleus.

R may, as previously stated, be selected from aliphatic, aromatic and mixed aliphatic-aromatic groups. These groups may or may not be substituted. If they are substituted, it would be preferred that they be electron donating substituents although election withdrawing substituents may be tolerated. Preferably R is selected from alkyl groups of 1 to 20 carbon atoms, preferably n-alkyl groups of 2 to 20 carbon atoms, aryl groups such as phenyl or naphthyl groups, with phenyl groups preferred, alkaryl groups, for example benzyl groups, and allyl groups. Where the term 'group' is used anywhere in the practice of the present invention, as opposed to the term 'radical', the possibility of substitution is specifically intended to be included within the definition of that term. For example, n-alkyl radical may be only of the formula—$(CH_2)_n$—$CH_3$ while n-alkyl group may have hydrogen atoms on the n-alkyl radical substituted with other moieties such as halogen atoms, hydroxyl radicals, alkoxy radicals, alkyl radicals, amine radicals, cyano radicals, etc. Specific examples of useful R moieties are ethyl, n-butyl, n-propyl, 4-methoxybutyl, 3-chloropropyl, 8-hydroxyoctyl, phenyl, benzyl, allyl, p-ethylphenyl, m-tert-butylnaphthyl, p-diethylaminophenyl, stearyl, dodecyl, etc. R preferably has fewer than 20 carbon atoms, but may have up to 30 or more carbon atoms. The main influence of this group, except where electronic induction occurs because of a change of the nature of this group, is in the solubility of the compound.

Y may, as previously stated, be selected from aliphatic, aromatic, and mixed aliphatic-aromatic groups. These groups may or may not be substituted. Examples of useful moieties are methyl, ethyl, n-pentyl, nonyl, stearyl, tolyl, anisyl (m-, p-, and o-), p-chlorobenzyl, o-bromobenzyl, p-hydroxybenzyl, veratryl isobutyl, terphthalyl p-octyloxybenzyl, p-dimethylaminophenyl, t-butyl, etc. Preferred Y moieties are phenyl, tolyl, anisyl, and benzyl groups because of their availability. As with group R, the main influence of this group, except with regard to electron induction effects, is on the solubility of the compounds. Preferably Y has 20 or fewer carbon atoms, but up to 30 may be readily tolerated. These compounds are disclosed in a commonly assigned U.S. patent application Ser. No. 237,068, Attorney's Docket No. 31,479, filed in the name of John J. Stofko, Jr. et al on the same day as this application.

The indolenine sensitizers which are a part of the present invention are disclosed in U.S. Pat. No. 4,025,347. This reference teaches the use of the indolenine dyes in silver halide emulsions as sensitizer dyes.

The dyes may be represented by the formulae:

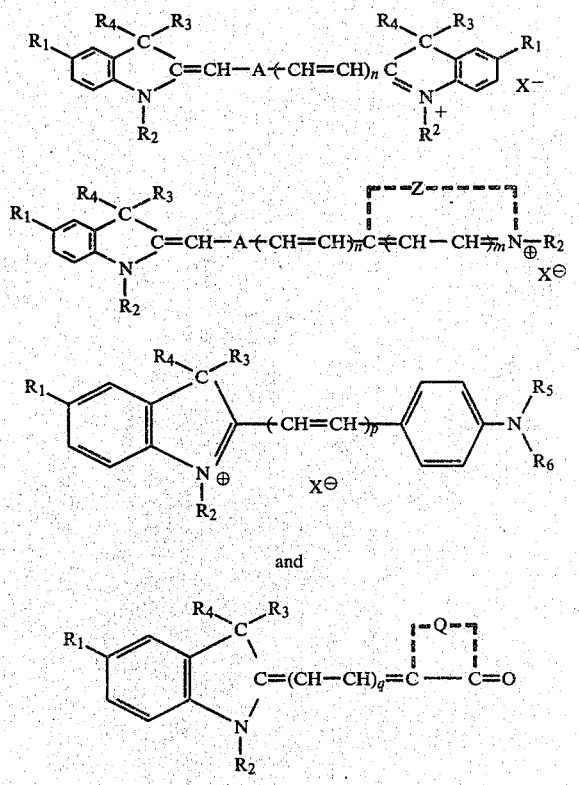

wherein A is selected from

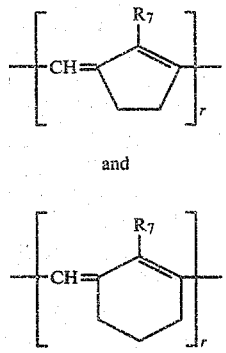

n represents a positive integer of from 1 to 4, m and q each represents a positive integer of from 1 to 2, p represents a positive integer of from 1 to 3, r is 0 or 1, $R_2$ represents a substituent independently selected from the group consisting of an acyclic hydrocarbon substituent (substituted or not), preferably aliphatic, such as an alkyl group (including substituted alkyl), preferably containing from 1 to 13 carbon atoms, e.g., methyl, ethyl, propyl, isopropyl, butyl, sec-butyl, hexyl, cyclohexyl, dodecyl, octadecyl, hydroxyalkyl (e.g. ω-hydroxyethyl, ω-hydroxypropyl, etc.), and alkenyl substituents, such as allyl, 1-propenyl, 2-propenyl, 1-butenyl, 2-butenyl and 3-butenyl, etc.; alkaryl substituents such as benzyl and β-phenylethyl; and aryl substituents, e.g., phenyl, p-tolyl, o-tolyl, 3,4-dichlorophenyl, etc., groups; $R_1$ represents a 5-position substituent selected from phenylsulfonyl or benzoyl; $X^-$ represents an acid anion such as for example, in order of general preference perchlorate, tetrafluoroborate, p-toluenesulfonate, methylsulfate, sulfamate, iodide, bromide, and chloride; $R_3$ and $R_4$ represents a substituted or non-substituted aliphatic group such as an alkyl group of from 1–12 carbon atoms, e.g., methyl, γ-sulfopropyl, isopropyl, butyl, sec-butyl, ω-sulfobutyl, dodecyl, β-hydroxyethyl, γ-hydroxypropyl, β-methoxyethyl, β-ethoxyethyl, allyl, benzyl, β-phenylethyl, β-carboxyethyl, carboxymethyl, γ-carboxypropyl, β-acetoxyethyl, γ-acetoxypropyl, carbomethoxymethyl, carboxyethoxyethyl, etc., groups; $R_5$ and $R_6$ each represents the same or different alkyl group of from 1–6 carbon atoms, e.g., methyl, ethyl, 2-cyanoethyl, propyl, isopropyl, butyl, hexyl, etc., groups, X represents any anion such as an acid ion, e.g., chloride, bromide, iodide, thiocyanate, sulfamate, methyl sulfate, ethyl sulfate, perchlorate, p-toluenesulfonate, etc., $R^7$ is selected from the group of hydrogen, halogen (particularly chloro and bromo), cyano, alkyl (preferably with no more than 4 carbon atoms, although longer chains may prevent increased solubility in certain materials), alkoxy (preferably with no more than 4 carbon atoms), phenoxy, aryl (e.g., phenyl, naphthyl, thienyl, tolyl), amino (e.g., $NH_2$, methylamino, diethylamino, phenylamino, methylphenylamino), thiophenyl, thioalkyl (preferably with no more than 4 carbon atoms), and the like, the chloro substituent being preferred; Z represents the non-metallic atoms required to complete a heterocyclic nucleus containing from 5 to 6 atoms in the heterocyclic ring, which may also include, in addition to the hetero nitrogen atom, a second hetero atom such as an oxygen atom, a sulfur atom, a selenium atom, or a second nitrogen atom, such as the atoms required to complete a thiazole nucleus (e.g., thiazole, 4-methylthiazole, 4-phenyl-thiazole, 5-methylthiazole, 5-phenylthiazole, 4,5-dimethylthiazole, 4,5-diphenylthiazole, 4-(2-thienyl)-thiazole, etc.); a benzothiazole nucleus (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, etc.); a naphthothiazole nucleus (e.g., α-naphthothiazole, β-naphthothiazole, 5-methoxy-β-naphthothiazole, 5-ethoxy-β-naphthothiazole, 8-methoxy-α-naphthothiazole, 7-methoxy-α-naphthothiazole, etc.); a thianaphtheno-7′, 6′, 4,5-thiazole nucleus (e.g., 4′-methoxythianaphtheno-7′, 6′, 4,5-thiazole, etc.); an oxazole nucleus (e.g., 4-methyloxazole, 5-methyloxazole, 4-phenyloxazole, 4,5-diphenyloxazole, 4-ethyloxazole, 4,5-dimethyloxazole, 5-phenyloxazole, etc.); a benzoxazole nucleus (e.g., benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 5-ethoxybenzoxazole, 6-chlorobenzoxazole, 6-methoxybenzoxazole, 5-hydroxybenzoxazole, 6-hydroxybenzoxazole, etc.); a naphthoxazole nucleus (e.g., α-naphthoxazole, β-naphthoxazole, etc.); a selenazole nucleus (e.g., 4-methylselenazole, 4-phenylselenazole, etc.); a benzoselenazole nucleus (e.g., benzoselenazole, 5-chlorobenzoselenazole, 5-methoxybenzoselenazole, 5-hydroxybenzoselenazole, tetrahydrobenzoselenazole, etc.); a naphthoselenazole nucleus (e.g., α-naphthoselenazole, β-naphthoselenazole, etc.); a thiazoline nucleus (e.g., thiazoline, 4-methylthiazoline, etc.); a 2-quinoline nucleus (e.g., quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, etc.); a 4-quinoline nucleus (e.g., quinoline, 6-methoxyquinoline, 7-methylquinoline, 8-methylquinoline, etc.); a 1-isoquinoline nucleus (e.g., isoquinoline, 3,4-dihydroisoquinoline, etc.); a 3-isoquinoline nucleus (e.g., isoquinoline, etc.); a 3,3-dialkylindolenine nucleus (e.g., 3,3-dimethylindolenine, 3,3,5-trimethylindolenine, 3,3,7-trimethylindolenine, etc.); a 2-pyridine nucleus (e.g., pyridine, 3-methylpyridine, 4-methylpyridine, 5-methylpyridine, 3,4-dimethylpyridine, 4-chloropyridine, 3-hydroxypridine, 3-phenylpyridine, etc.); a 4-pyridine nucleus (e.g., 2-methylpyridine, 3-methylpyridine, 3-chloropyridine, 2,6-dimethylpyridine, 3-hydroxypyridine, etc.); a 1-alkylimidazole nucleus (e.g., 1-methylimidazole, 1-ethyl-4-phenylimidazole, 1-butyl-4,5-dimethylimidazole, etc.); a 1-alkylbenzimidazole nucleus (e.g., 1-methylbenzimidazole, 1-butyl-4-methylbenzimidazole, 1-ethyl-5,6-dichlorobenzimidazole, etc.); and a 1-alkyl-naphthimidazole nucleus (e.g., 1-ethyl-α-naphth imidazole, 1-methyl-β-naphthimidazole, etc.); and, Q represents the non-metallic atoms required to complete a 5 to 6 membered heterocyclic nucleus, typically containing a hetero atom selected from nitrogen, sulfur, selenium, and oxygen, such as a 2-pyrazolin-5-one nucleus (e.g., 3-methyl-1-phenyl-2-pyrazolin-5-one, 1-phenyl-1-pyrazolin-5-one, 1-(2-benzothiazolyl)-3-methyl-2-pyrazolin-5-one, etc.); an isoxazolone nucleus (e.g., 3-phenyl-5(4H)-isoxazolone, 3-methyl-5-(4H)-isoxazolone, etc.); an oxindole nucleus (e.g., 2,4,6-triketohexahydropyrimidine nucleus (e.g., barbituric acid or 2-thiobarbituric acid as well as their 1-alkyl (e.g., 1-methyl-1-ethyl, 1-propyl, 1heptyl, etc.) or 1,3-dialkyl (e.g., 1,3-dimethyl, 1,3-diethyl, 1,3-dipropyl, 1,3-diisopropyl, 1,3-dicyclohexyl, 1,3-di(β-methoxyethyl), etc., or 1,3-diaryl (e.g. 1,3-diphenyl, 1,3-di(p-chlorophenyl), 1,3-di(p-ethoxycarbonylphenyl), etc.), or 1-aryl (e.g., 1-phenyl, 1-p-chlorophenyl, 1-p-ethoxycarbonylphenyl), etc. or 1-alkyl-3-aryl (e.g., 1-ethyl-3-phenyl, 1-n-heptyl-3-phenyl, etc.) derivatives); a rhodanine nucleus (i.e., 2-thio-2,4-thiazolidinedione series), such as rhodanine, 3-alkylrhodanines (e.g., 3-ethylrhodanine, 3-allylrhodanine, etc.), 3-carboxyalkylrhodanines (e.g., 3-(2-carboxyethyl)rhodanine, 3-(4-carboxybutyl)rhodanine, etc.), 3-sulfoalkylrhodanines (e.g., 3-(2-sulfoethyl)rhodanine, 3-(3-sulfopropyl)rhodanine, 3-(4-sulfobutyl)rhodanine, etc.) or 3-arylrhodanines (e.g., 3-phenylrhodanine, etc.), etc.; a 2(3H)-imidazo-[1,2-a]-pyridone nucleus; a 5,7-dioxo-6,7-dihydro-5-thiazolo[3,2-a]pyrimidine nucleus (e.g., 5,7-dioxo-3-phenyl-6,7-dihydro-5-thiazolo[3,2-a]pyrimidine, etc.); a 2-thio-2,4-oxazolidinedione nucleus (i.e., those of the 2-thio-2,4(3H,5H)-oxazoledione series) (e.g., 3-ethyl-2-thio-2,4-oxazolidinedione, 3-(2-sulfoethyl)-2-thio-2,4-oxazolidinedione, 3-(4-sulfobutyl)-2-thio-2,4-oxazolidine-dione, 3-(3-carboxypropyl)-2-thio-2,4-oxazolidinedione, etc.); a thianaphthenone nucleus (e.g., 3-(2H)-thianaphthenone, etc.); a 2-thio-2,5-thiazolidinedione nucleus (i.e., the 2-thio-2,5-(3H,4H)-thiazoledione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-α-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-α-naphthyl-4-thiazolidinone, etc.); a 2-thiazolin-4-one series (e.g., 2-ethyl-mercapto-2-thiazolin-4-one, 2-alkylphenylamino-2-thiazolin-4-one, 2-diphenylamino-2-thiazolin-4-one, etc.); a 2-imino-4-oxazolidinone (i.e., pseudohydantoin)) nucleus; a 2,4-imidazolidinedione (hydantoin) series (e.g., 2,4-imidazolidinedione, 3-ethyl-2,4-imidazolidinedione, 3-phenyl-2,4-imidazolidinedione, 3-α-naphthyl-2,4-imidazolidinedione, 1,3-diethyl-2,4-imidazolidinedione, 1-ethyl-3-phenyl-2,4-imidazolidinedione 1-ethyl-3-naphthyl-2,4-imidazolidinedione, 1,3-diphenyl-2,4-imidazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(4-sulfobutyl)-2-thio-2,4-imidazoidinedione 3-(2-carboxyethyl)-2-thio-2,4-imidazolidinedione, 3-phenyl-2-thio-2,4-imidazolidinedione, 3-α-naphthyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-α-naphthyl-2-thio-2,4-imidazolidinedione, 1,3-diphenyl-2-thio-2,4-imidazolidinedione, etc.); a 2-imidazolin-5-one nucleus (e.g., 2-propylmercapto-2-imidazolin-5-one, etc.), etc. (especially useful are nuclei wherein Q represents a heterocyclic nucleus containing 5 atoms in the heterocyclic ring, 3 of said atoms being carbon atoms, 1 of said atoms being a nitrogen atom, and 1 of said atoms being selected from the group consisting of a nitrogen atom, an oxygen atom, and a sulfur atom).

Surprisingly the counterion (the acid anion, $X^-$) has been found to significantly affect the sensitizing ability of the dyes according to the present invention. The reason for this is not understood. The general order of preference for the anions is perchlorate (most preferred), tetrafluoroborate, p-toluenesulfonate, methylsulfate, sulfamate, iodide, bromide, and chloride.

The dyes are those of U.S. Pat. No. 4,025,347 in which the indolenine portion of the dye bears a 5-phenylsulfonyl or 5-benzoyl substituent.

Various binder materials known in the art are useful with the electronically active electron donor compounds of the present invention. It is of course preferred that the binder be essentially optically transparent or at least transparent to the wavelengths of radiation to which the compounds (sensitized or not) are sensitive. Amongst the useful binders are poly(vinyl chloride), poly(siloxanes), poly(vinyl butyral), poly(vinyl acetate), styrene/acrylonitrile copolymers, polyacrylates, polymethacrylates, polycarbonates, polyepoxides, polyurethanes, polyamides, polyethers, polyesters, polyolefins as well as block, graft, random, and alternating polymers, copolymers, terpolymers and mixtures thereof and the like. The binders are preferably electrically inactive themselves. The preferred polymeric binders are polycarbonates, polyesters, and styrene/acrylonitrile copolymers. Coating aids, lubricants, surface active agents, and other adjuvants may be added to the composition.

For use of the materials of the present invention as electrophotographic layers, the organic electron donor compounds should be present as at least 20 percent by weight of the composition. Preferably the donor compound should be present as at least 25 or 35 percent by weight of the layer, and may comprise up to 100% by weight of the layer, excluding of course the sensitizer dye. The sensitizing dyes should be used in amounts which will increase the sensitivity of the composition. This is defined as an effective sensitizing amount of dye. Ordinarily amounts of up to 10% by weight dye may be used, but certain constructions can be envisaged with as much as 90% by weight of dye and 10% by weight of organic electron donor compounds. Amounts of dye as small as 0.005 percent by weight can be useful. More preferred concentration ranges are between 0.05 and 5 percent by weight.

The photosensitive materials of the present invention may also be useful as photoconductive toners, photovoltaic devices, organic semiconductors, and the like, and may use concentrations of organic electron donor compounds as low as 5 percent by weight.

It has been surprisingly noted that the benzocarbazole-aldehyde condensation products useful in the present invention are better charge transport materials than the corresponding benzocarbazoles by themselves. This is surprising because it is the benzocarbazole nucleus which is the electronically active portion of both molecules. Even when benzocarbazoles were used in reasonably higher molecular proportions to the binder than were the condensates, the condensates would still perform better.

These and other aspects of the present invention will be shown in the following examples.

EXAMPLE 1

Synthesis of bis-5,5'-(N-ethylbenzo[a]carbazolyl)phenylmethane

Into a round bottom flask equipped with a reflux condenser and a mechanical stirrer were added 22.4 grams (0.1 mole) of N-ethylbenzo[a]carbazole and 5.3 grams (0.05 mole) of benzaldehyde. Two hundred milliliters of ethanol acidified with 8 ml of concentrated hydrochloric acid were then added. The mixture was stirred at reflux under a nitrogen atmosphere for sixteen hours. The insoluble, pure white product was isolated by filtration washed with 100 ml of ethanol, and dried in a vacuum oven. The yield was 95% of the theoretic calculation.

EXAMPLES 2–17

In a manner substantially identical to that of the previous example, electronically active electron donor compounds of the present invention were obtained by condensing N-ethylbenzo[a]carbazole with each of the following aldehydes in equimolar replacement for the benzaldehyde:

2. p-tolualdehyde
3. m-tolualdehyde
4. o-tolualdehyde
5. p-anisaldehyde
6. m-anisaldehyde
7. o-anisaldehyde
8. p-chlorobenzaldehyde
9. p-bromobenzaldehyde
10. o-bromobenzaldehyde
11. p-hydroxybenzaldehyde
12. α-naphthaldehyde
13. veratraldehyde
14. p-octyloxybenzaldehyde
15. iso-butyraldehyde
16. n-nonylaldehyde
17. terphthaldehyde

EXAMPLES 18–21

In a manner substantially identical to that of Example 1, the following combinations of carbazoles and aldehydes were used to synthesize compounds of the present invention.

18. benzo[a]carbazole and benzaldehyde
19. N-ethylbenzo[b]carbazole and benzaldehyde
20. N-ethyldibenzo[a]carbazole and benzaldehyde
21. N-ethyl-8-methoxybenzo[a]carbazole and benzaldehyde The addition of any of the compounds produced in Examples 1–21 to electrically inert polymeric binders formed positive charge transport layers. These layers could be formed on photoconductive charge generating layers and were capable of supporting injected photogenerated holes from the photoconductive layer and allowed the transport of these holes through the transport layer to selectively discharge the surface charge.

Cyclohexene and cyclopentene intermediates used in the synthesis of dyes used in the present invention may be prepared, for example, according to the teachings of J. Zemlika and Z. Arnold, *Collect. Czech. Chem. Commun.* 26, 2852 (1961), S. M. Makin, L. I. Boiko, and O. A. Shavrygina, Zh. Org. Khim., Vol. 13, No. 6, pp. 1189–92 (1977), Zh, Org. Khim., Vol. 13, No. 11, pp. 2440–43 (1977), Y. U. L. Slominskii, I. D. Radchenko, A. I. Tolmachev, Zh. Org. Khim., Vol. 14, No. 10, pp. 2214–2221 (1978), Zh. Org. Khim, Vol. 15, No. 2, pp. 400–407 (1979), and G. A. Reynolds and K. H. Drexhage, *J. Org. Chem.* 42, (5) 885 (1977).

All indolenine dyes used in the practice of the present invention may be prepared according to known techniques such as those disclosed in U.S. Pat. No.

4,025,347. Examples of more complex synthetic procedures are shown below.

EXAMPLE 22

Preparation of 1-ethyl-2-[(1-ethyl-3,3-dimethyl-5-phenyl-sulfonylindolenine-2yl)-4-chloro-3,5-trimethylene-1,3,5-heptatrienylidene]-3,3-dimethyl-5-phenylsulfonylindoleinium iodide.

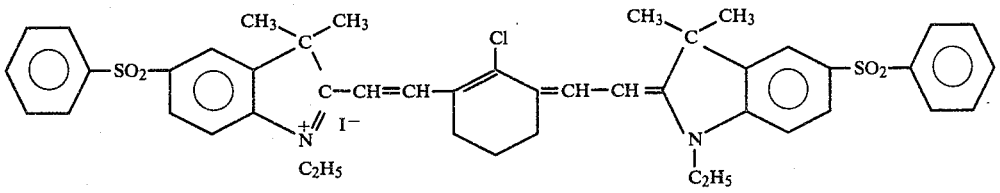

0.45 g of 1-ethyl-2,3,3-trimethyl-5-phenylsulfonylindoleninium iodide and 0.085 g of 1-formyl-2-chloro-3-hydroxymethylene-1,2-cyclohexene were dissolved in a mixture of 5 ml of acetic acid and 8 ml of acetic anhydride. After the addition of 0.12 g anhydrous sodium acetate, the reaction mixture was heated to reflux for 5 minutes and cooled overnight. The raw dye was purified by recrystallization from acetic acid. 0.32 g of pure dye were obtained. The dye exhibited a melting point of 226°-227° C., maximum absorbence at 788 nm (in acetone) and $[\epsilon]=2.57\times10^5$.

The p-toluene sulfonate counterpart of this dye was equivalently prepared using the p-toluene sulfonate indoleninium salt, 0.9 of the cyclohexene, and 80 g of acetic acid. A yield of 1.8 g of purified dye exhibited a melting point of 213°-215° C., a maximum absorbence at 788 nm (in acetone), and $[\epsilon]=2.93\times10^5$.

The 1-methyl indolenine iodide counterpart of this last compound was identically prepared using 1-methyl indoleninium salts. It displayed a melting point of 182°-183° C., maximum absorbence at 786 nm (in acetone), and $[\epsilon]=1.94\times10^5$.

EXAMPLE 23

Preparation of 1-ethyl-2-[(1-ethyl-3,3-dimethyl-5-phenylsulfonylindolenine-2-yl)-4-chloro-3,5-dimethylene-1,3,5-heptatrienylidene]-3,3-dimethyl-5-phenylsulfonylindoleninium p-toluenesulfonate.

A solution of 4.99 g 1-ethyl-3,3-dimethyl-5-phenylsulfonylindoleninium p-toluenesulfonate and 1.25 g of 1-dimethylammonium-methylene-2-chloro-3-dimethylamino-methylene-1,2-cyclopentene chloride in 80 ml of acetic anhydride was prepared and heated at 110° C. for ninety minutes. After cooling, the reaction solution was poured into ethyl ether with stirring. The solid material was filtered on a Buchner funnel and dissolved in 200 ml boiling acetone. The solution was poured into 400 ml of boiling water. The dye separated upon cooling, yielding 1.8 g of dye displaying a melting point of 193-195, maximum absorbence at 811 nm (in acetone) and $[\epsilon]=2.93\times10^5$.

EXAMPLE 24

Preparation of 1-ethyl-2-[(1-ethyl-3,3-dimethyl-5-benzoylindolenine-2-yl)-4-chloro-3,5-trimethylene-1,3,5-hetatrienylidene]-3,3-dimethyl-5-benzoylindoleninium p-toluenesulfonate.

A solution of 2.4 g of 1-ethyl-2,3,3-trimethyl-5-benzoylindoleninium p-toluenesulfonate and 0.45 g of 1-formyl-2-chloro-3-hydroxymethylene-1,2-cyclohexene in 60 ml of acetic anhydride was prepared and heated at 100° C. for one hour. After cooling at room temperature, the reaction solution was poured into 200 ml of ethyl ether and the solid material obtained was filtered on a Buchner funnel and repeatedly washed with ethyl ether. 0.5 g of pure dye was obtained by recrystalization from acetone. The dye displayed a melting point of 208°-210° C., a maximum absorbence at 797 nm (in acetone), and $[\epsilon]=2.81\times10^5$.

EXAMPLE 25

Preparation of 1-ethyl-2-[(1-ethyl-3,3-dimethyl-5-benzoylindolenine-2-yl)-4-chloro-3,5-dimethylene-1,3,5-heptatrienylidene]-3,3-dimethyl-5-benzoylindolenine p-toluenesulfonate.

A solution of 4.3 g 1-ethyl-2,3,3-trimethyl-5-benzoylindoleninium p-toluenesulfonate and 1.17 g 1-dimethylammonium-methylene-2-chloro-3-dimethylaminomethylene-1,2-cyclopentene in 80 ml of acetic anhydride was prepared and heated at 110° C. for ninety minutes. After cooling at room temperature, the reaction solution was poured into 400 ml of ethyl ether with stirring. The solid product was filtered and redissolved in 800 ml of boiling acetone. This solution was poured into 400 ml of hot water. After cooling, 0.25 g of green dye was collected on a Buchner funnel and washed with 200 ml of an acetone/ethyl ether (1:4) solution. The dye displayed a melting point of 223°-234° C., a maximum absorbence at 822 nm, and $[\epsilon]=2.67\times10^5$.

Different counterions and substituents on these dyes may be readily obtained by appropriate selection of the reagents.

EXAMPLE 26

A solution consisting of 0.6 g Vitel PE-200 organic solvent soluble polyester; 0.4 g of Bis-5,5'-(N-ethylbenzo[a]carbozylyl)-phenylmethane, and 0.005 g 5-phenylsulfonyl-indolenine dye 1 in a mixture of 4.5 g dichloromethane, and 4.5 g of 1,2-dichloroethane was prepared, filtered, and knife coated onto an aluminized polyester substrate. The wet thickness of the coating was 4 mil ($1\times10^{-4}$ m). The coating was allowed to air dry and was then oven dried for 15 minutes at 80° C. The electrophotographic performance of this construction, determined by measuring the energy required to discharge the sample to half of its initial value (E $V_{o/2}$), is shown in the accompanying Table.

EXAMPLES 27-48

A solution consisting of 0.6 g Vitel PE-200, 0.4 g of transport material indicated, and 0.005 g of the 5-phenylsulfonyl-indolenine dye indicated in a mixture of 4.5 g of dichloromethane and 4.5 g of 1.2-dichloroethane was prepared, filtered, and knife coated onto an aluminized polyester substrate. The wet thickness of the coating was 4 mil ($1\times10^{-4}$ m). The coating was allowed to air dry and then oven dried for 15 minutes at 80° C. The electrophotographic performance of these constructions, determined by measuring the energy required to discharge the sample to half of their initial values (E $V_{o/2}$), is shown in the accompanying Table.

EXAMPLE 49

A solution consisting of 1.0 g of polyvinylcarbazole and 0.005 g of 5-phenylsulfonyl-indolenine dye 5 in a mixture of 4.5 g of dichloromethane and 4.5 g of 1,2-dichloroethane was knife coated onto an aluminized polyester substrate. The wet thickness of the coating was 4 mil ($1\times10^{-4}$ m). The coating was air dried and then oven dried for 15 minutes at 80° C. The electrophotographic behavior of this construction, determined by measuring the energy required to discharge the sample to half of its initial voltage (E $V_{o/2}$) is shown in the accompanying Table.

EXAMPLES 50–55

The procedures of Examples 21–42 were employed except that 0.005 g of 5-benzoyl-indolenine dyes were employed in place of the 5-phenylsulfonyl-indolenine dyes used previously. The electrophotographic behavior of these constructions, determined by measuring the energy required to discharge the samples to half of their initial voltage, are shown in the accompanying Table.

TABLE

| Example | Dye | Transport Material | Wavelength | Exposure E $V_{o/2}$ |
|---|---|---|---|---|
| 26 | 1 | Bis-5,5'-(N-ethylbenzo[a]carbazolyl)phenylmethane | 850 nm | 60 ergs/cm$^2$ |
| 27 | 2 | Bis-5,5'-(N-ethylbenzo[a]carbazolyl)phenylmethane | 800 nm | >200 ergs/cm$^2$ |
| 28 | 3 | Bis-5,5'-(N-ethylbenzo[a]carbazolyl)phenylmethane | 800 nm | >200 ergs/cm$^2$ |
| 29 | 4 | Bis-5,5'-(N-ethylbenzo[a]carbazolyl)phenylmethane | 800 nm | 78 ergs/cm$^2$ |
| 30 | 5 | Bis-5,5'-(N-ethylbenzo[a]carbazolyl)phenylmethane | 800 nm | 34 ergs/cm$^2$ |
| 31 | 6 | Bis-5,5'-(N-ethylbenzo[a]carbazolyl)phenylmethane | 800 nm | >200 ergs/cm$^2$ |
| 32 | 7 | Bis-5,5'-(N-ethylbenzo[a]carbazolyl)phenylmethane | 800 nm | 110 ergs/cm$^2$ |
| 33 | 8 | Bis-5,5'-(N-ethylbenzo[a]carbazolyl)phenylmethane | 800 nm | 180 ergs/cm$^2$ |
| 34 | 9 | Bis-5,5'-(N-ethylbenzo[a]carbazolyl)phenylmethane | 800 nm | 60 ergs/cm$^2$ |
| 35 | 10 | Bis-5,5'-(N-ethylbenzo[a]carbazolyl)phenylmethane | 800 nm | >200 ergs/cm$^2$ |
| 36 | 11 | Bis-5,5'-(N-ethylbenzo[a]carbazolyl)phenylmethane | 800 nm | 99 ergs/cm$^2$ |
| 37 | 12 | Bis-5,5'-(N-ethylbenzo[a]carbazolyl)phenylmethane | 800 nm | 60 ergs/cm$^2$ |
| 38 | 13 | Bis-5,5'-(N-ethylbenzo[a]carbazolyl)phenylmethane | 800 nm | 220 ergs/cm$^2$ |
| 39 | 14 | Bis-5,5'-(N-ethylbenzo[a]carbazolyl)phenylmethane | 800 nm | >200 ergs/cm$^2$ |
| 40 | 15 | Bis-5,5'-(N-ethylbenzo[a]carbazolyl)phenylmethane | 800 nm | >200 ergs/cm$^2$ |
| 41 | 5 | Bis-5,5'-(N-propylbenzo[a]carbazolyl)-phenylmethane | 800 nm | 140 ergs/cm$^2$ |
| 42 | 5 | Bis-5,5'-(N-ethylbenzo[a]carbazolyl)-m-methoxyphenylmethane | 800 nm | 80 ergs/cm$^2$ |
| 43 | 5 | 1,5-diphenyl-3-styrylpyrazoline | 800 nm | 54 ergs/cm$^2$ |
| 44 | 5 | 1-phenyl-3-(p-methoxystyryl)-5-(p-methoxyphenyl)pyrazoline | 800 nm | 100 ergs/cm$^2$ |
| 45 | 5 | 4,4'-bis(diethylamino)-2,2'-dimethyltriphenylmethane | 800 nm | 326 ergs/cm$^2$ |
| 46 | 5 | N,N,N',N'-tetrabenzyl-m-phenylenediamine | 800 nm | >1700 ergs/cm$^2$ |
| 47 | 5 | 2,2-bis-(p-diethylaminophenyl)-1,3,4-oxadiazole | 800 nm | 120 ergs/cm$^2$ |
| 48 | 5 | p-diethylaminobenzaldehyde-(diphenyldiazone) | 800 nm | 140 ergs/cm$^2$ |
| 46 | 5 | polyvinylcarbazole | 800 nm | 80 ergs/cm$^2$ |
| 50 | 16 | Bis-5,5'-(N-ethylbenzo[a]carbazolyl)phenylmethane | | |
| 51 | 17 | Bis-5,5'-(N-ethylbenzo[a]carbazolyl)phenylmethane | 850 nm | 188 ergs/cm$^2$ |
| 52 | 18 | Bis-5,5'-(N-ethylbenzo[a]carbazolyl)phenylmethane | | |
| 53 | 19 | Bis-5,5'-(N-ethylbenzo[a]carbazolyl)phenylmethane | 800 nm | 83 ergs/cm$^2$ |
| 54 | 20 | Bis-5,5'-(N-ethylbenzo[a]carbazolyl)phenylmethane | 800 nm | >200 ergs/cm$^2$ |
| 55 | 21 | Bis-5,5'-(N-ethylbenzo[a]carbazolyl)phenylmethane | 800 nm | >200 ergs/cm$^2$ |

1.
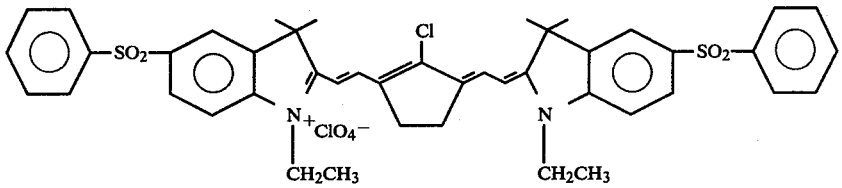
λmax = 813 nm
2.
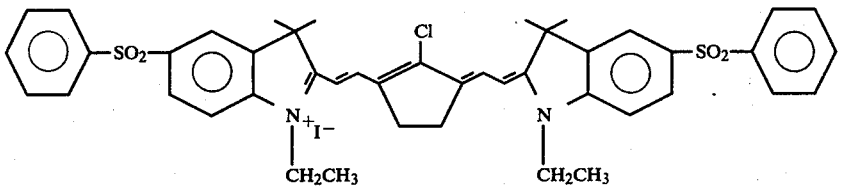
λmax = 809 nm
$\epsilon = 3.32 \times 10^5$
3.
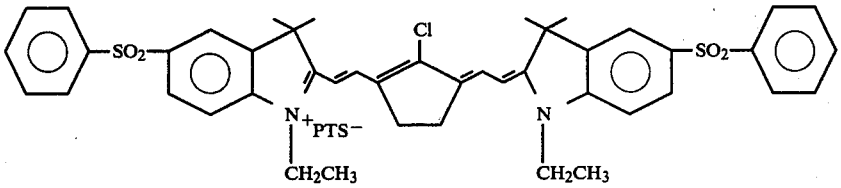
p-toluenesulfonate (PTS)
λmax = 811 nm
4.
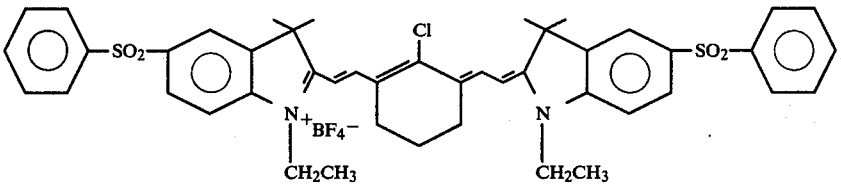
λmax = 786 nm (acetone)
$\epsilon = 4.1 \times 10^5$
5.
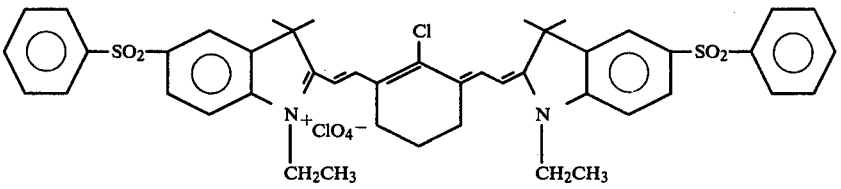
λmax = 787 nm
6.
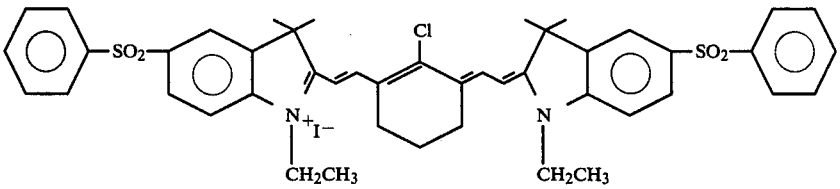
λmax = 788 nm
$\epsilon = 2.57 \times 10^5$ -continued
7.
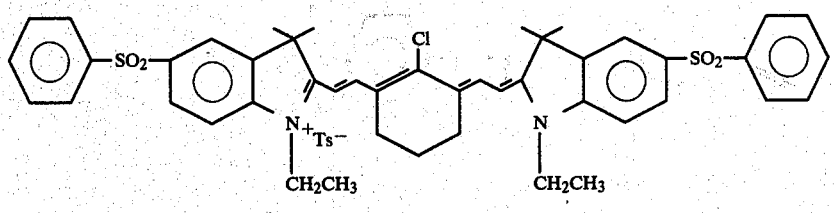
λmax = 787 nm
8.
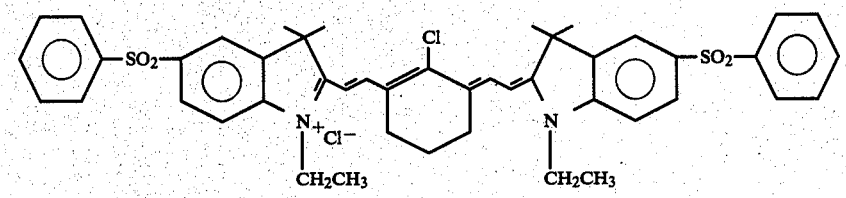
λmax = 788 nm
9.
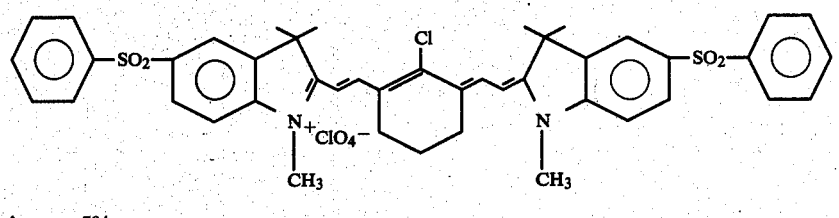
λmax = 784 nm
10.
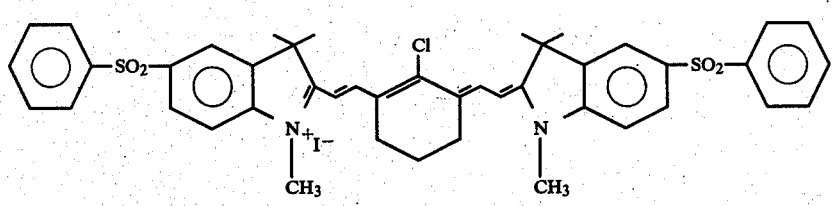
λmax = 786 nm
11.
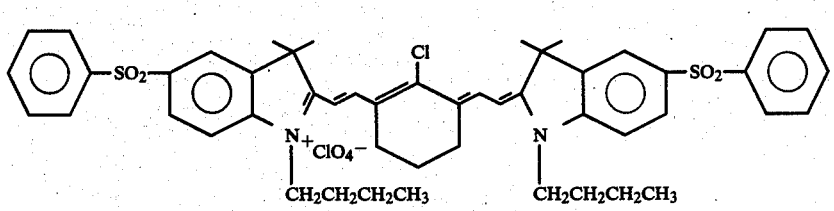
λmax = 792 nm (acetone)
$\epsilon = 3.2 \times 10^5$
mp = 230–230.5° C.
12.
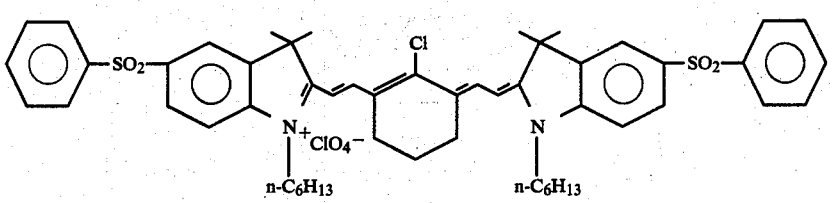
λmax = 794 nm
$\epsilon = 2.82 \times 10^5$ -continued
13.
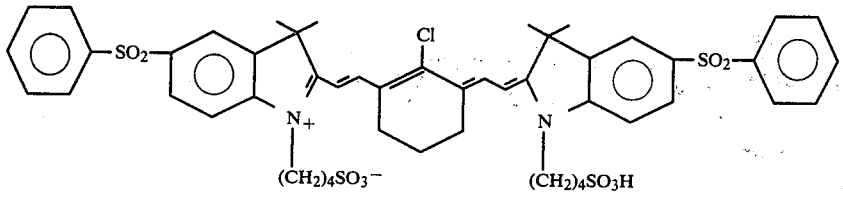
λmax = 792 nm
ε = 2.42 × $10^5$
14.
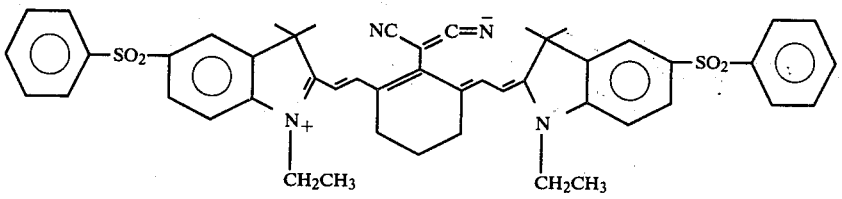
λmax = 790 nm
15.
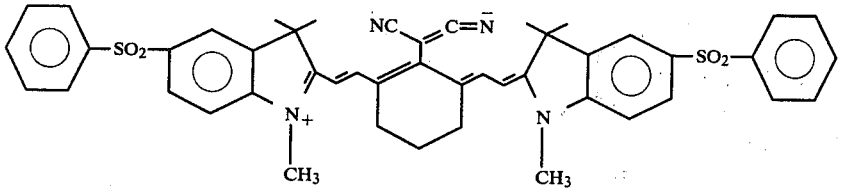
λmax = 784 nm
16.
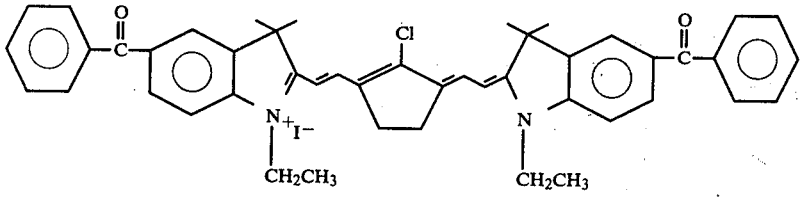
λmax = 822 nm
ε = 2.21 × $10^5$
17.
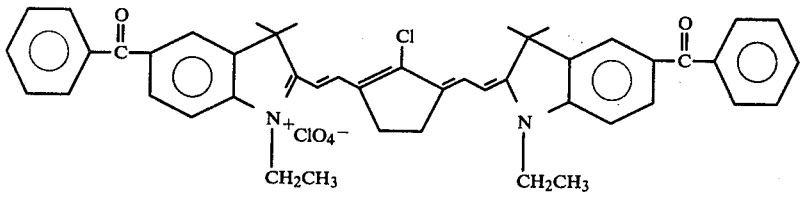
λmax = 822 nm (acetone)
ε = 2.5 × $10^5$
mp = 246-247° C.
18.
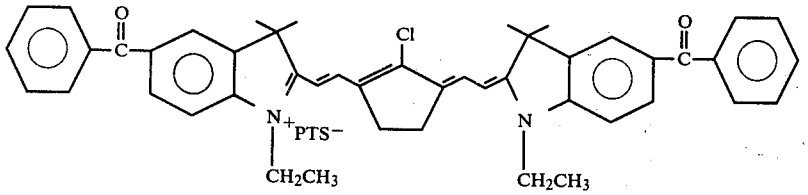
λmax = 822 nm (acetone)
ε = 2.67 × $10^5$
mp = 222-223.5° C.

-continued

19.

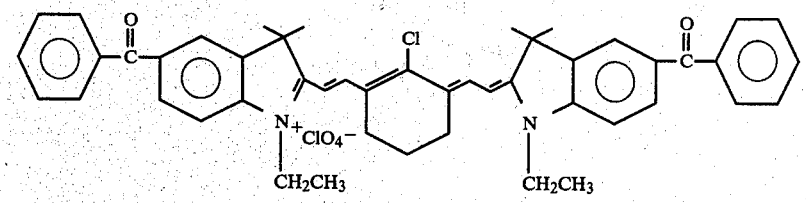

λmax = 797 nm

20.

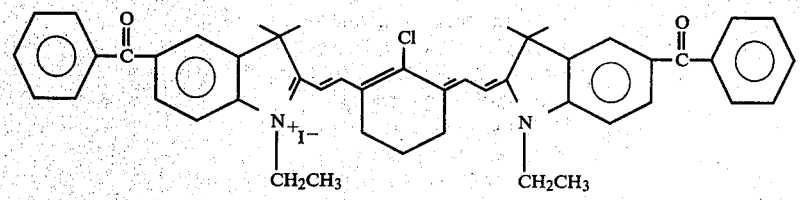

λmax = 797 nm

21.

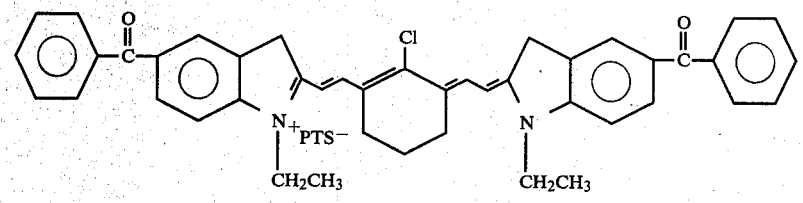

λmax = 797 nm

We claim:

1. A photosensitive material comprising an organic electronically active donor compound sensitized with a sensitizing amount of an indolenine cyanine dye bearing a phenylsulfonyl or benzoyl substituent on the 5-position thereof.

2. A layer of the photosensitive material of claim 1 wherein said donor compound is a polyvinyl carbazole.

3. A layer of the photosensitive material of claim 1 wherein said donor compound is present as at least 20% by weight in an electronically inactive polymeric binder.

4. A layer of the photosensitive material of claim 1 wherein said donor compound is a benzocarbazole derivative of the formula

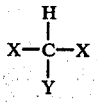

where X is

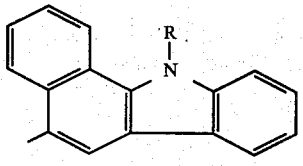

or

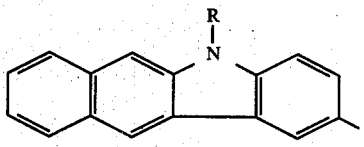

wherein R and Y are independently selected from the group consisting of aliphatic, aromatic, and mixed aliphatic-aromatic groups.

5. The layers of claims 2, 3 or 4 in which said indolenine dye is represented by any of the formulae:

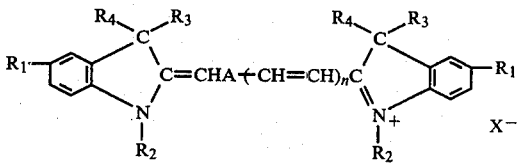

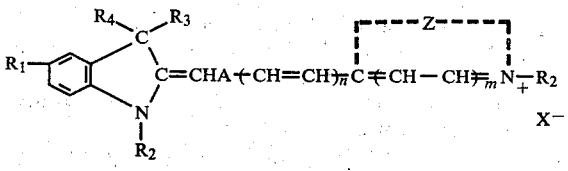

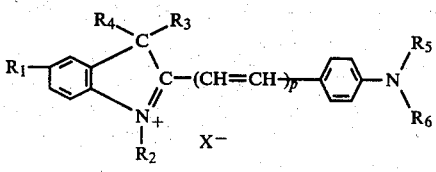

and

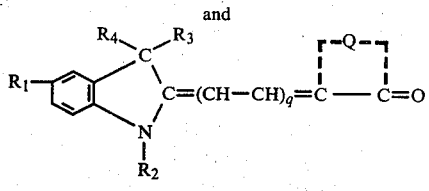

wherein

A is selected from

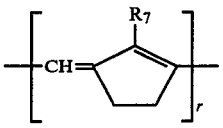

and

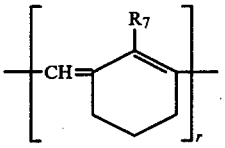

n is a positive integer of 1 to 4,
m and q each represents a positive integer of 1 to 2,
p represents a positive integer of 1 to 3,
r is 0 or 1, $R_2$ represents an acyclic hydrocarbon,
$R_1$ is a 5-position phenylsulfonyl or benzoyl substituent,
$R_5$ and $R_6$ are an aliphatic group,
$R_3$ and $R_4$ represent the same or different alkyl groups of 1–6 carbon atoms,
$R_7$ is selected from the group consisting of H, halogen, cyano, alkyl, alkoxy, phenoxy, aryl, amino, thiophenyl, and thioalkyl,
Z represents the non-metallic atoms required to complete a heterocyclic nucleus of 5 to 6 ring atoms,
Q represents the non-metallic atoms required to complete a heterocyclic nucleus of 5 to 6 ring atoms, and
X represents an acid anion.

6. The layer of claims 2, 3, or 4 in which said indolenine dye is represented by the formula:

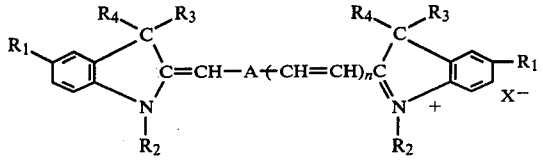

wherein,
n is 1,
r is 1,
$R^2$ is an aliphatic group of 1 to 13 carbon atoms,
$R^1$ is phenylsulfonyl or benzoyl,
$R^3$ and $R^4$ are selected from the group consisting of methyl, ethyl, propyl, butyl, pentyl and hexyl,
$R^7$ is halogen, and
$X^-$ is an acid anion.

7. The layer of claims 2, 3, or 4 in which said indolenine dye is represented by the formula:

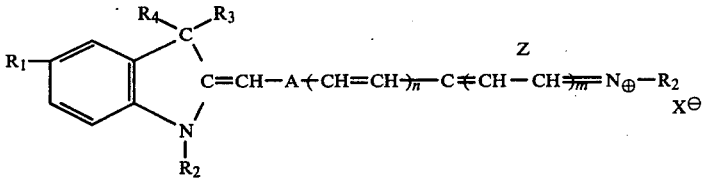

wherein
A is selected from

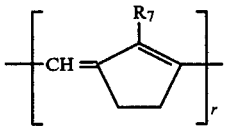

and

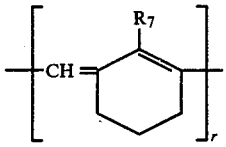

r is 1,
n is 1,
$R^2$ is an aliphatic group of 1 to 13 carbon atoms,
$R^1$ is a phenylsulfonyl or benzoyl group,
$R^3$ and $R^4$ are selected from the group consisting of methyl, ethyl, propyl, butyl, pentyl, and hexyl,
$R^5$ and $R^6$ are alkyl of 1 to 6 carbon atoms,
$R^7$ is halogen, and
X is an acid anion.

8. An electrophotographic element comprising, in sequence, a conductive substrate and the layer of claim 5.

* * * * *